US006913386B2

(12) United States Patent
Maher et al.

(10) Patent No.: US 6,913,386 B2
(45) Date of Patent: Jul. 5, 2005

(54) BAG WITH ADJUSTABLE SLIDING DIVIDER

(75) Inventors: Toody Maher, 713 Solano Ave., Albany, CA (US) 94705; Branko Lukic, Menlo Park, CA (US); Jonathan I. Kaplan, Palo Alto, CA (US); Sean M. Corcorran, Palo Alto, CA (US); Adam H. Prost, Burlingame, CA (US)

(73) Assignee: Toody Maher, Albany, CA (US)

( * ) Notice: Subject to any disclaimer, the term of this patent is extended or adjusted under 35 U.S.C. 154(b) by 34 days.

(21) Appl. No.: 10/268,646

(22) Filed: Oct. 10, 2002

(65) Prior Publication Data

US 2004/0071371 A1 Apr. 15, 2004

(51) Int. Cl.[7] ..... B65D 30/22

(52) U.S. Cl. ..... 383/38; 190/110; 220/531; 220/550

(58) Field of Search ..... 383/38; 190/109–110; 150/112–113; 220/549–550, 529–531; 211/43

(56) References Cited

U.S. PATENT DOCUMENTS

| | | | | | |
|---|---|---|---|---|---|
| 174,262 | A | * | 2/1876 | Kuhnle | 211/43 |
| 470,553 | A | | 3/1892 | Dozier | |
| 919,745 | A | | 4/1909 | McCaw | |
| 1,046,021 | A | | 12/1912 | Rhone | |
| 1,089,939 | A | | 3/1914 | Maxwell | |
| 1,211,853 | A | | 1/1917 | Huggins | |
| 1,338,776 | A | | 5/1920 | Jennings | |
| 1,734,049 | A | * | 11/1929 | Ritter Jr. | 190/110 |
| 1,768,379 | A | * | 6/1930 | Smith | 40/651 |
| 2,229,299 | A | * | 1/1941 | Loucks | 220/549 |
| 2,415,054 | A | * | 1/1947 | Weil | 220/549 |
| 2,911,024 | A | | 11/1959 | Miceli | |
| 2,988,125 | A | | 6/1961 | Reynolds | |
| 3,335,775 | A | | 8/1967 | Adams | |
| 4,542,826 | A | * | 9/1985 | Adams | 206/427 |
| 4,738,363 | A | * | 4/1988 | Hudson | 206/427 |
| 4,880,315 | A | | 11/1989 | Berry et al. | |
| 4,976,375 | A | * | 12/1990 | Quam | 220/534 |
| 5,009,315 | A | * | 4/1991 | Robare | 206/427 |
| 5,082,139 | A | * | 1/1992 | Quam | 220/530 |
| 5,350,045 | A | | 9/1994 | Robertson | |
| 5,873,504 | A | | 2/1999 | Farmer | |
| 5,961,216 | A | | 10/1999 | Quinn et al. | |
| 6,186,201 | B1 | | 2/2001 | Salz | |
| 6,298,993 | B1 | | 10/2001 | Kalozdi | |
| 6,382,377 | B2 | * | 5/2002 | Godshaw | 190/110 |

* cited by examiner

*Primary Examiner*—Jes F. Pascua
(74) *Attorney, Agent, or Firm*—Morrison & Foerster LLP

(57) ABSTRACT

An adjustable sliding divider partitions the interior of a bag such that various contents in the bag may be separated and protected. The divider slides along the bottom of the bag to change the size of the partitions as desired by the user. The divider may also be folded down on the bottom of the bag when not in use.

29 Claims, 8 Drawing Sheets

BAG WITH ADJUSTABLE SLIDING DIVIDER

FIELD OF THE INVENTION

The invention relates generally to bags, and more specifically, to bags with sliding, adjustable partitions or a system for adjustably partitioning the interior of bags through a sliding mechanism.

BACKGROUND OF THE INVENTION

Most bags today face the same problem: how to provide structure within the bag to separate and protect the contents of the bag while still keeping a malleable form in order to maintain the convenience of transporting or carrying the bag when it is empty. This problem is pervasive with all types of bags, whether specialized or general, for all purposes. For example, reusable all-purpose canvas tote bags are commonly used at grocery stores or supermarkets. These all-purpose tote bags are convenient because they are lightweight, collapsible, and easy to carry in their empty form. However, because such canvas tote bags have no structure, the contents of the bag are highly susceptible to shifting and jarring, thereby subjecting the more fragile contents (e.g., soft fruits, eggs, etc.) to possible damage.

In contrast, more specialized bags, such as gym or tennis bags, tend to have firmer structure in order to accommodate multiple compartments for specialized content. However such bags are heavier, larger, and bulkier than all-purpose general bags, making them more inconvenient to carry, transport, or store. Furthermore, such compartmentalized bags are often difficult to clean because the compartments create crevices or corners where dust, dirt, food, and other particles may be collected and trapped.

As such, what is needed is an easier-to-clean bag having a structure for separating and protecting the diverse contents in the bag while still maintaining the convenience of a lightweight, easy-to-carry, easy-to-store, malleable form when the bag is empty.

SUMMARY OF THE INVENTION

The present invention provides a bag with temporary structure to separate and protect the contents of the bag while still maintaining the convenience of a lightweight, easy-to-carry, easy-to-store, malleable form when the bag is empty. In one embodiment of the present invention, such a bag comprises at least one partition board that is slidably coupled to the bottom of the bag. Such coupling enables the partition board to slide along the bottom of the bag, thereby allowing a user to, as desired, dynamically adjust the size of the partitions of the bag created by the partition board. In another embodiment of the present invention, such a bag comprises at least one partition board coupled to a sliding mechanism that slides along the bottom of the bag. In either embodiment, the bottom of the bag may include a base board that may be either integrated into the shell of the bag or removable from the interior of the bag.

The present invention also provides an adjustable partitioning system for a bag that provides temporary structure while still permitting the bag to maintain its malleable form. In one embodiment of the present invention, the system comprises a base board and at least one partition board that is slidably coupled to the base board. Such a system may, for example and without limitation, be placed into an all-purpose tote bag, thereby partitioning the interior of the bag as desired by the user. Because the partition board can slide along the base board, the user can dynamically adjust the size of the partitions in the bag in order to accommodate and separate various types of content. In another embodiment of the present invention, the system comprises a base board, at least one partition board, and at least one sliding mechanism that is coupled to the partition board and slidably coupled to the base board, thereby enabling the partition board to slide along the base board.

As such, the present invention provides a user the capability to create structure through partitioning in order to separate and protect diverse contents in a bag. Such partitioning is also adjustable such that the user can dynamically change the size of the partitions in the bag by sliding a partition board. In one embodiment of the present invention, such a partition board is also collapsible, such that the partition board can fold down on the bottom of the bag. In another embodiment, the present invention offers a temporary structure that can be ultimately removed in order to maintain the easy-to-clean, easy-to-carry, easy-to-store, malleable characteristics of the bag when it is empty.

Further objects and advantages of the present invention will become apparent from a consideration of the drawings and detailed description. The invention described herein is advantageous because it enables a bag to accommodate variable amounts and types of content. For example, such a bag would be desirable as a gym bag, for dividing clean clothes from dirty clothes. Similarly, such a bag would be desirable as a beach bag or pool bag, for separating wet and dry clothes. Such a bag could also be used as a diaper or tool bag, providing the user with the capability of separating baby items or tools, respectively. The present invention may be directed towards satisfying such needs.

DETAILED DESCRIPTION OF THE INVENTION

Figure 1A:
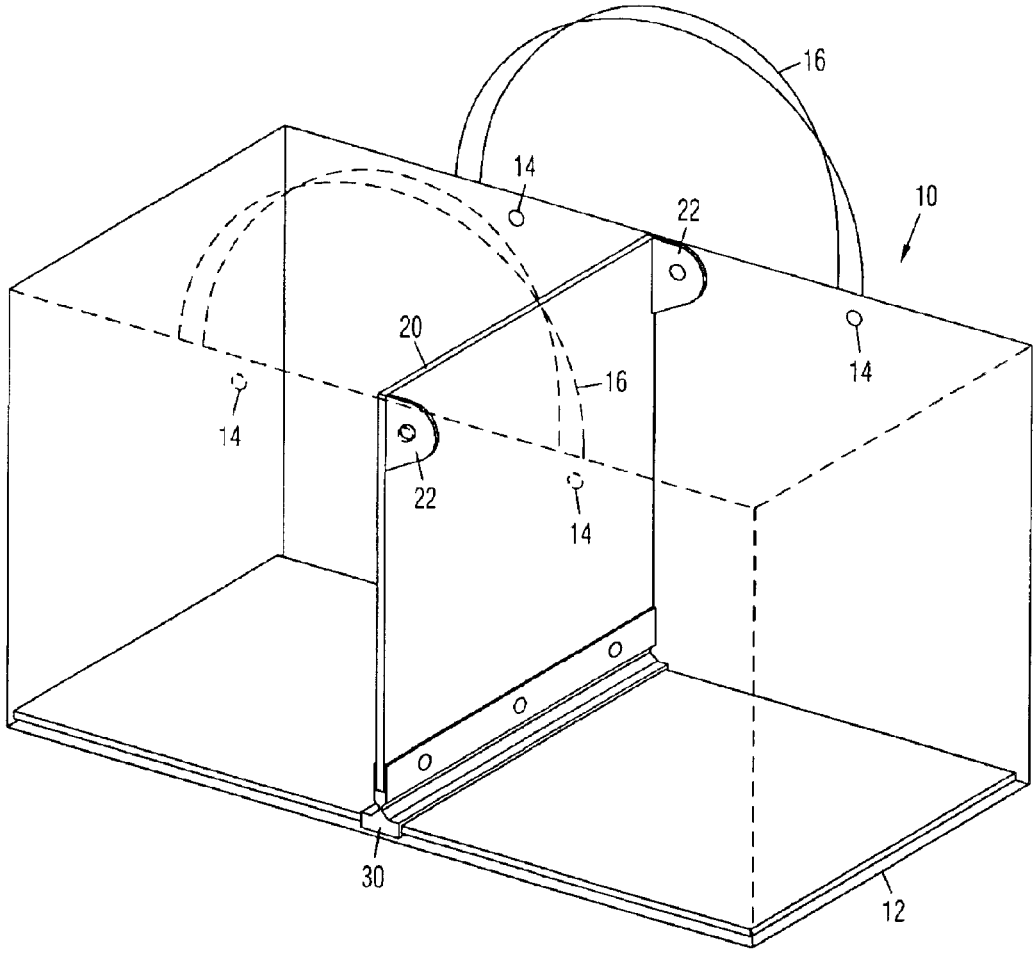
FIG. 1A is a perspective view of a bag with a partition board slidably coupled to the bottom of the bag.

Referring to the drawings, FIG. 1A illustrates a bag 10 with a partition board 20 slidably coupled to the bottom of the bag. The bag includes a bottom 12, a plurality of fastening snaps 14 located at the top of opposing sides of the bag, and handles 16. As shown, the bottom 12 of the bag in FIG. 1A includes a base board. The shell of the bag may be easily folded or stored and may be a made from a variety of materials, including without limitation, canvas, laminate, polyester, leather, plastic mesh, paper or any other type of fabrics or materials known to those skilled in the art.

In accordance with the invention, the bag 10 comprises at least one partition board 20 that divides the interior of the bag into separate compartments. This partition board 20 may be made from, for example, corrugated plastic, cardboard, woven mesh or any other lightweight, rigid and strong material known to those skilled in the art. Such a partition board 20 may also be covered with additional fabric, laminate, sealed vinyl, or any other type of covering to match the material or design of the shell of the bag as well as to water-proof the partition board 20 or enable a user to easily clean it (e.g., using a sponge on a laminate or sealed vinyl covering). The partition board 20 may also include a set of "ears" 22 with snaps located on the top of the partition board 20 in order to fasten the top of the partition board 20 to the top of shell of the bag via corresponding fastening snaps 14. For example, such ears may be made of flexible material, such as a strip of webbing that is sown, glued, or otherwise attached across the top of partition board 22. Alternatively, small vertical slits may be made in the top corners of the partition board 22 such that the flexible material can be horizontally weaved through the slits thereby creating the ears. Those skilled in the art will recognize that fastening mechanisms other than the snaps illustrated in FIG. 1A may be used to attach the partition board to the shell of the bag including, without limitation, buttons, hook and loop fasteners, and any other types of fasteners. The partition board 20 is also slidably coupled to the bottom of the bag.

As shown in FIG. 1A, the bottom of the bag 10 includes a base board that may be made from any form of lightweight, rigid and strong material known to those skilled in the art. The partition board 20 is coupled to a sliding mechanism 30 that is detachably wrapped around the edges of the base board. Such detachable wrapping of the sliding mechanism 30 to the base board should be loose enough to enable the partition board 20 to easily slide along the base board but also be firm enough to hold it in place, even with considerable weight pressing against it. That is, such detachable wrapping of the sliding mechanism to the base board should be tight enough such that a user would need to use reasonable force to move it—the partition will remain in place and will only move when such movement is intentional.

The sliding mechanism may be configured so that it will lock in position if it is pushed anywhere other than at its center. For example, as shown in FIG. 1A, the width of the sliding mechanism 30 may be designed to be narrow relative to the width of the base board. In such a design, the further the sliding mechanism is pushed or pulled from its center, the more likely that the sliding mechanism will attempt to rotate rather than slide, thereby binding itself against the base board and locking itself in position. Furthermore, the base of a partition board 20 may have, for example, a centrally located hole, large enough for a user to reach down and put several fingers through in order push or pull the partition from side to side.

While FIG. 1A illustrates a sliding mechanism 30 that is detachably wrapped around both the top and bottom edges of the base board, those skilled in the art will also recognize that alternative embodiments of the present invention may utilize different sliding mechanisms, for example and without limitation, one that is only detachably wrapped around the top edges of the base board, thereby loosely extending into the sides of the base board. Rather than wrapping completely around the sides of the base board, such a sliding mechanism may utilize guiding slots, grooves or notches along the sides of the base board.

Figure 1B:
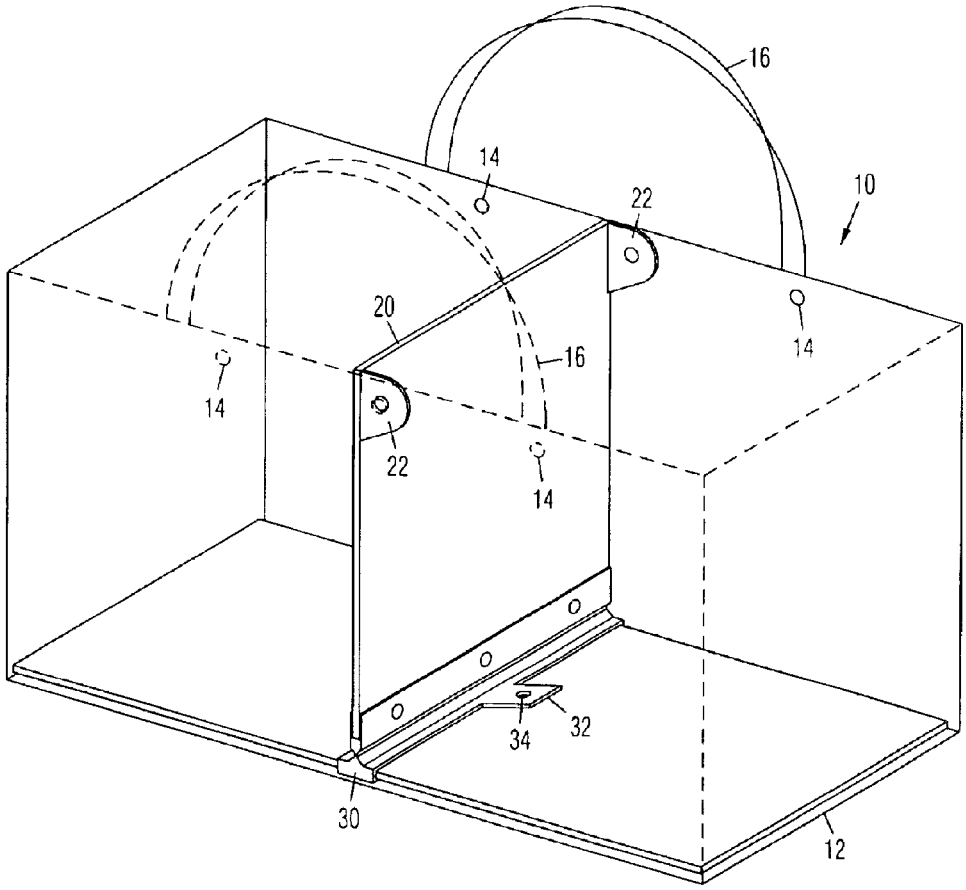
FIG. 1B is a perspective view of a bag with a partition board (with pull tabs) slidably coupled to the bottom of the bag.

Furthermore, as illustrated in FIG. 1B, the sliding mechanism 30 may also include at least one tab 32 that may be pulled to adjust the location of the partition board 20. For example and without limitation, the tab 32 may contain a finger hole 34 to enable a user to easily pull it 32 in either direction along the base board. As shown in FIG. 1B, the tab 32 may also be placed in the middle of the sliding mechanism 30 such that the pressure applied by a finger onto the tab 32 neither offsets nor impedes the sliding mechanism 30, but rather facilitates its mobility.

Figure 2:
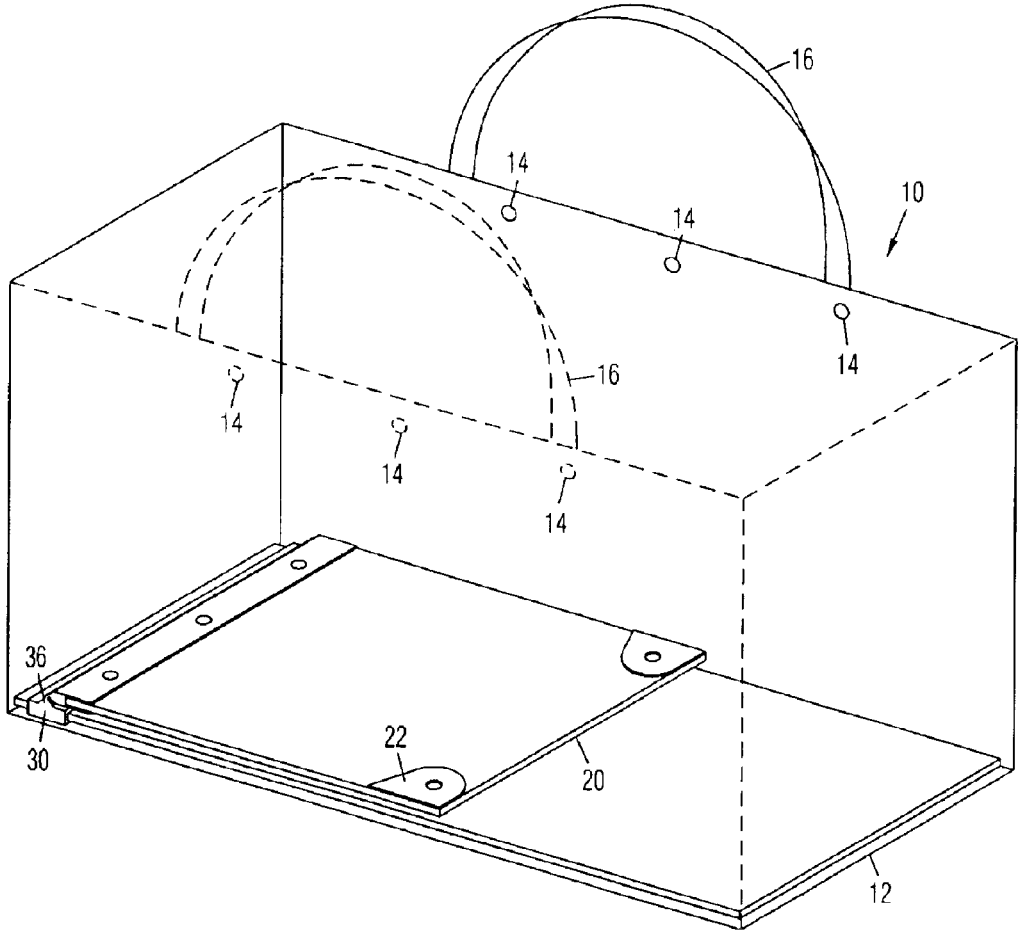
FIG. 2 is a perspective view of a bag with a partition board that has been collapsed onto the bottom of the bag.

FIG. 2 illustrates a bag 10 in accordance with another embodiment of the present invention wherein the partition board 20 can be folded down to lie against the bottom of the bag. For example and without limitation, the coupling of the partition board 20 to the sliding mechanism 30 includes a hinge 36 extending along the length of the sliding mechanism 30 enabling the partition board 20 to be folded down so that it lies along the bottom of the bag. Those skilled in the art will recognize that different designs may be used to implement the hinge 36. Such a hinge may be, for example and without limitation, a fabric hinge or a "living" hinge, made from a thin portion of plastic bridging the partition board and sliding mechanism and providing the ability to flex repeatedly. As discussed previously, the ears 22 of the partition board 20 may be made of flexible fabric or material such that they also fold down on top of or below the partition board 20 (e.g., when the partition board 20 has folded down).

In alternative embodiments of the present invention, the base board (if any) at the bottom of the bag may be either integrated into the shell of the bag or removable from the bag itself. Similarly, the sliding mechanism may be either integrated into the bottom of the bag (e.g., into the base board) or detachable. The partition board may also be separately removable, either with the sliding mechanism or without.

The present invention also provides an adjustable partitioning system for dividing the interior of a bag. Such a system may be used with different bags including, without limitation, disposable bags. For example and without limitation, such a system may be utilized in one bag until its shell becomes weak, worn, or dirty and then removed and placed into a newer bag.

Figure 3:
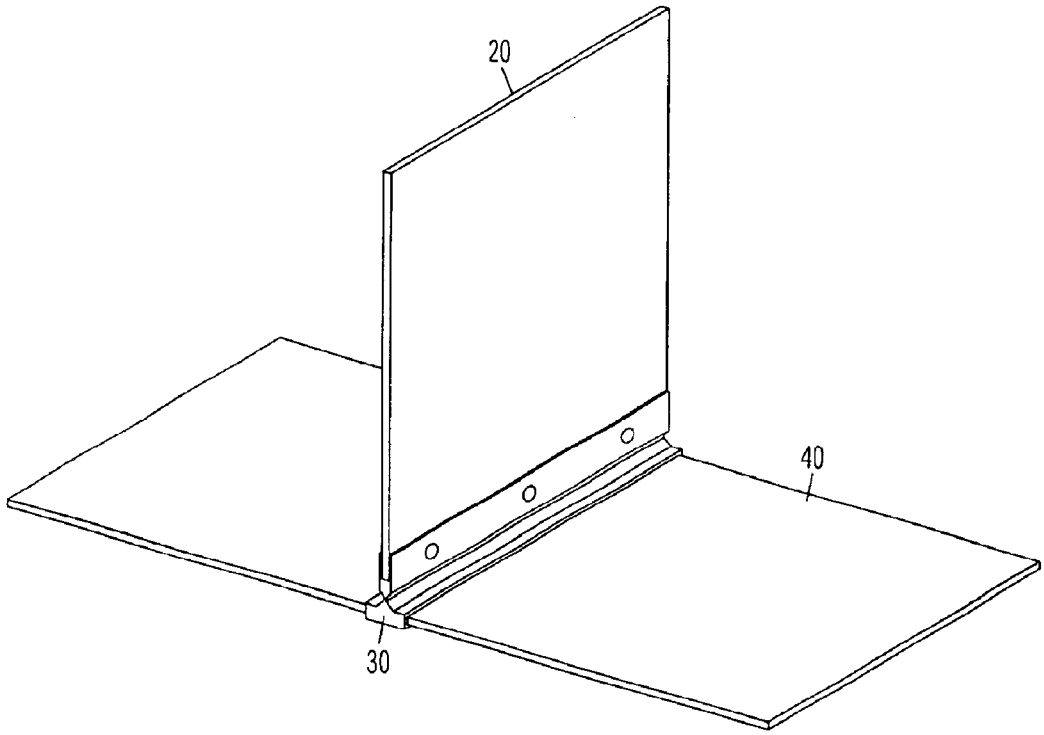
FIG. 3 is a perspective view of an adjustable partitioning system for dividing the interior of a bag.

FIG. 3 illustrates such a system having a partition board 20, a base board 40, and a sliding mechanism 30 that is coupled to the partition board 20 and slidably coupled to the base board 40. Such a system is placed in a bag to create partitions within the interior of the bag. Both the base board and the partition board in such a system may be made from, for example and without limitation, corrugated plastic, cardboard, woven mesh or any other lightweight, rigid and strong material known to those skilled in the art. Such a partition board may also be covered with additional fabric, laminate, sealed vinyl, or any other type of covering to water-proof the partition board or enable a user to easily clean it (e.g., using a sponge on a laminate or sealed vinyl covering). The partition board may optionally include a fastening mechanism (for example and without limitation, ears with snaps) in order to secure the top of the partition board 20 to the top of a shell of the bag with which it is used.

The sliding mechanism in FIG. 3 is a molding that is detachably wrapped around the edges of the base board 40. Such detachable wrapping of the sliding mechanism 30 to the base board 40 should be loose enough to enable the partition board 20 to easily slide along the base board but also be firm enough to hold it in place, even with considerable weight pressing against it. In one embodiment, the sliding mechanism may be configured so that it will lock in position if it is pushed anywhere other than at its center. For example, as shown in FIG. 3, the width of the sliding mechanism 30 may be designed to be narrow relative to the width of the base board. In such a design, the further the sliding mechanism is pushed or pulled from its center, the more likely that the sliding mechanism will attempt to rotate rather than slide, thereby binding itself against the base board and locking itself in position. Furthermore, the base of a partition board 20 may have, for example, a centrally located hole, large enough for a user to reach down and put several fingers through in order push or pull the partition from side to side.

While FIG. 3 illustrates a sliding mechanism 30 that is detachably wrapped around both the top and bottom edges of the base board, those skilled in the art will also recognize that alternative embodiments of the present invention may utilize different sliding mechanisms, for example and without limitation, one that is only detachably wrapped around the top edges of the base board, thereby loosely extending into the sides of the base board. Rather than wrapping completely around the sides of the base board, such a sliding mechanism may utilize guiding slots, grooves or notches along the sides of the base board.

As in FIG. 1B, the sliding mechanism 30 may also includes at least one tab that may be pulled to adjust the location of the partition board 20. For example and without limitation, the tab 32 may contain a finger hole to enable a user to easily pull it 32 in either direction along the base board 40. In alternative embodiments, the partition board 20 can be folded down to lie against the base board 40. For example and without limitation, the coupling of the partition board 20 to the sliding mechanism 30 may include a hinge extending along the length of the sliding mechanism 30 enabling the partition board 20 to be folded down so that it lies along the base board 40. Those skilled in the art will recognize that different designs may be used to implement the hinge. Such a hinge may be, for example and without limitation, a fabric hinge or a "living" hinge, made from a thin portion of plastic bridging the partition board 20 and sliding mechanism 30 and providing the ability to flex repeatedly. As seen in FIG. 3, the sliding mechanism 30 may be detachable from the base board 40 and the partition board 30 may also be removable.

Figure 4:
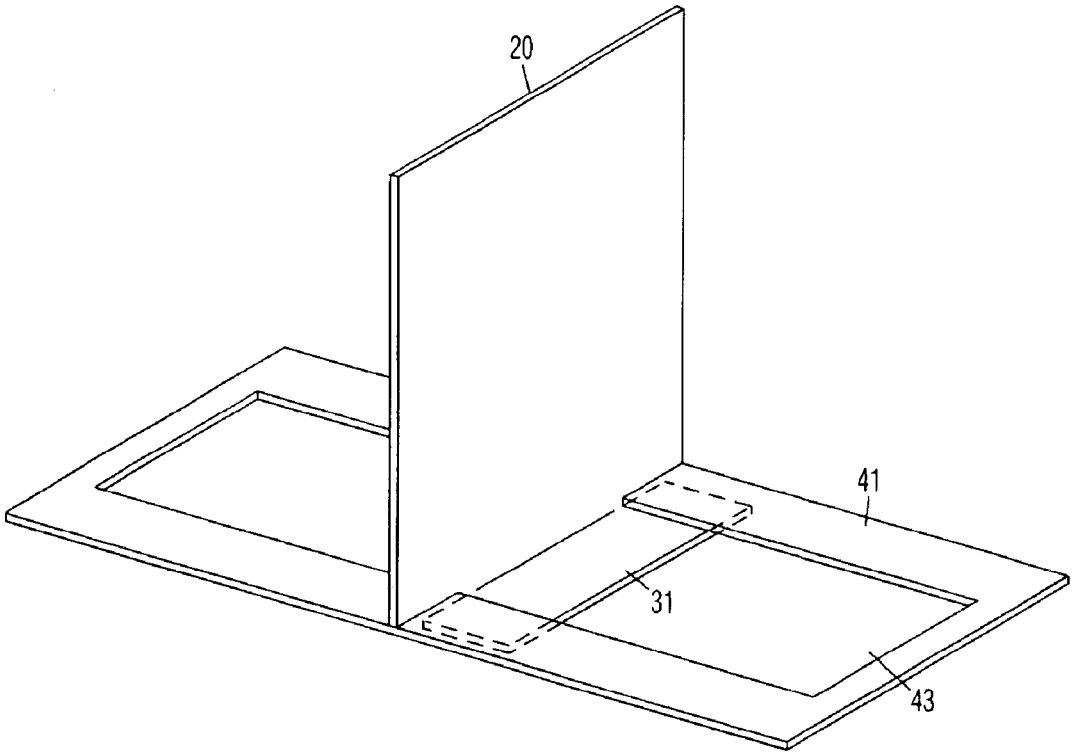
FIG. 4 is a perspective view of another adjustable partitioning system for dividing the interior of a bag.

FIG. 4 illustrates an alternative structure for the adjustable sliding partition used in the bag and system according to the invention. In this embodiment, the base board 41 comprises a hollow interior that supports a slide track 43 along the board 41. As seen in FIG. 4, the sliding mechanism 31 is a flat rigid member whose ends extend under the slide track 43 to create a sliding effect. The partition board 20 is coupled to this sliding mechanism 31 thereby enabling the partition board 20 to slide along the base board 41.

Figure 5:
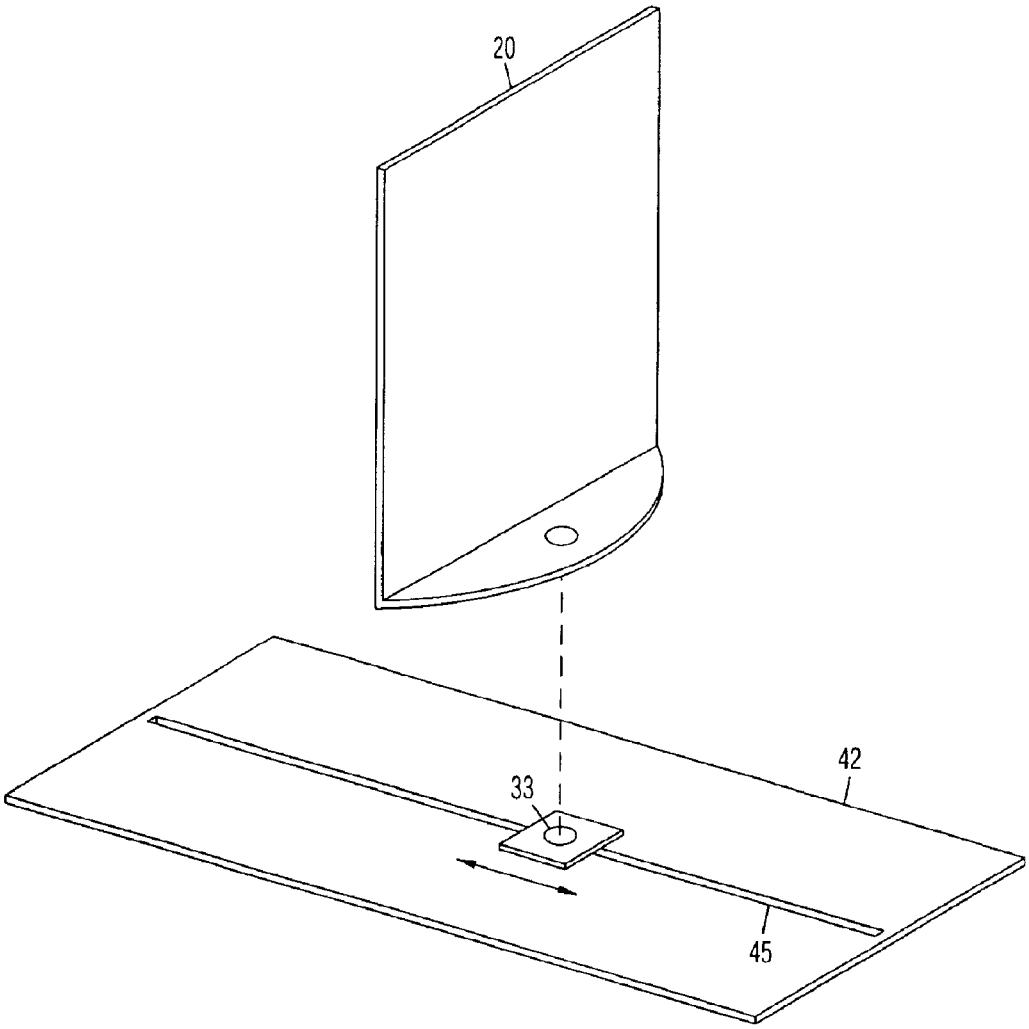
FIG. 5 is a perspective view of still another adjustable partitioning system for dividing the interior of a bag.

Another structure for the adjustable sliding partition used in the bag and system according to the invention is illustrated in FIG. 5. As seen in FIG. 5, the base board 42 includes a runner 45 that supports the sliding mechanism 33. The sliding mechanism 33 is loosely coupled to the base board 42 to enable it to slide along the runner 45. For example and without limitation, the sliding mechanism 33 may include a bolt-like member (e.g., screw) extending from its bottom that extends into the runner 42 and a securing member (e.g., nut) that loosely secures the sliding mechanism 33 to the runner, thereby creating a sliding member. Such a sliding mechanism, for example and without limitation, may provide the capability to lock the sliding mechanism in place (e.g., tighten the screw and nut) when desired. Furthermore, the sliding mechanism 33 may further comprise a fastening member such as, for example and without limitation, a button snap than enables a partition board 20 with a matching fastening member (e.g., button snap) to attach to the sliding mechanism 33.

Those skilled in the art will recognize that various features and characteristics from FIGS. 3, 4, and 5 may be combined to create further structures for an adjustable partition used in the bag and system according to the present invention. For example and without limitation, a sliding mechanism similar to the one in FIG. 3 could be combined with a locking mechanism similar to one in FIG. 5. Alternatively, other locking mechanisms might also be implemented—for example, a sliding mechanism may slide along a notched railing that enables the user to lock the sliding mechanism in place. Furthermore, those skilled in the art will recognize that the various embodiments of the adjustable sliding divider as shown in FIGS. 3, 4, and 5 may be incorporated into a bag in accordance with the present invention.

Figure 6A:
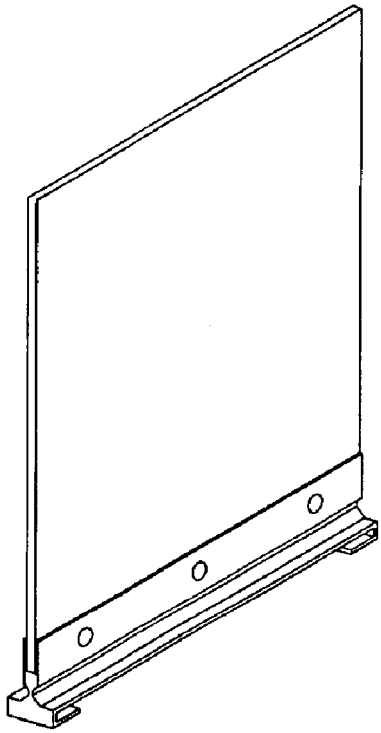
FIG. 6A is a perspective view of a partition board coupled to a sliding mechanism.
Figure 6B:
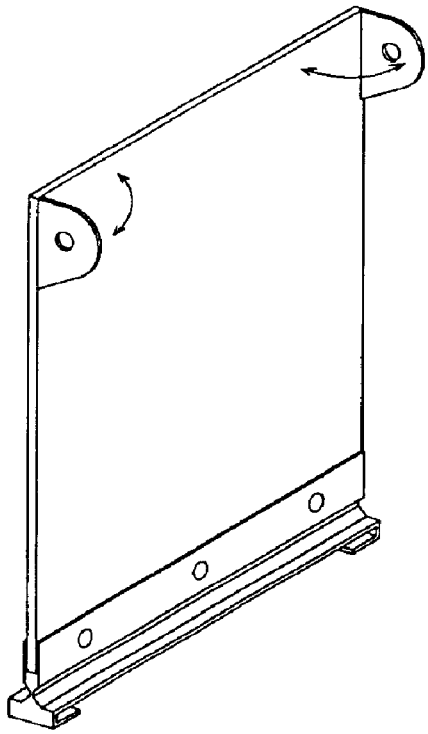
FIG. 6B is a perspective view of a partition board (with a fastening mechanism) coupled to a sliding mechanism.

FIG. 6A and FIG. 6B illustrate various configurations of partition boards that may be used with the present invention. The partition board may be made from, for example and without limitation, corrugated plastic, cardboard, woven mesh or any other lightweight and rigid material strong enough to separate contents in the interior of a bag. Such a partition board may also be covered with additional fabric, laminate, sealed vinyl, or any other type of covering to match the material or design of the shell of a bag as well as to water-proof the partition board or enable a user to easily clean it (e.g., using a sponge on a laminate or sealed vinyl covering). As illustrated in FIG. 6B, the partition board may also include a set of "ears" with snaps located on the top of the partition board in order to fasten the top of the partition board to the top of shell of the bag. For example, such ears may be made of flexible material, such as a strip of webbing that is sown, glued, or otherwise attached across the top of partition board. Alternatively, small vertical slits may be made in the top corners of the partition board such that the flexible material can be horizontally weaved through the slits thereby creating the ears. Those skilled in the art will recognize that fastening mechanisms other than snaps may be used to attach the partition board to the shell of the bag including, without limitation, buttons, hook and loop fasteners, and any other types of fasteners. Such ears may be made from flexible material or fabric such that they may fold down against the partition board when they are not in use. Furthermore, FIGS. 6A and 6B illustrate that the bottom of the partition board is coupled to a sliding mechanism. Additionally, the base of a partition board may have, for example, a centrally located hole, large enough for a user to reach down and put several fingers through in order push or pull the partition from side to side.

Although the partition boards in FIGS. 6A and 6B are both coupled to the same type of sliding mechanism, those skilled in the art will recognize that alternative sliding mechanisms may be used, including without limitation, those sliding mechanisms illustrated in FIGS. 3, 4, and 5. Additionally, in some embodiments, the partition board may be readily detachable or removable from the sliding mechanism. In other embodiments, the partition board may be permanently coupled to the sliding mechanism. In such embodiments, the partition board and sliding mechanism may be readily detachable or removable from a base board or the bottom of a bag.

Figure 7A:
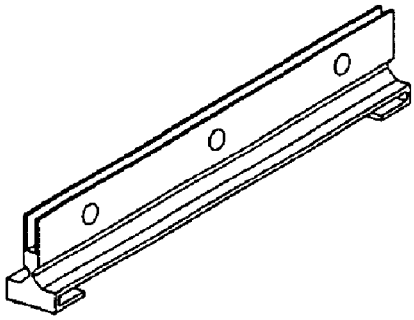
FIG. 7A is a perspective view of a sliding mechanism.

FIGS. 7A–7D illustrate various configurations and enhancements for a sliding mechanism in accordance with the present invention. In FIG. 7A, the sliding mechanism is a molding that can be detachably wrapped around the edges of a base board in the bottom of a bag. Such detachable wrapping of the sliding mechanism to the base board should be loose enough to enable the molding to easily slide along the base board but also be firm enough to hold it in place, even with considerable weight pressing against it. That is, such detachable wrapping of the sliding mechanism to the base board should be tight enough such that a user would need to use reasonable force to move it—the partition will remain in place and will only move when such movement is intentional.

The sliding mechanism may be configured so that it will lock in position if it is pushed anywhere other than at its center. For example, the width of the sliding mechanism may be designed to be narrow relative to the width of the base board. In such a design, the further the sliding mechanism is pushed or pulled from its center, the more likely that the sliding mechanism will attempt to rotate rather than slide, thereby binding itself against the base board and locking itself in position. Such a molding may be detachably wrapped around both the top and bottom edges of the base board, or alternatively, for example and without limitation, detachably wrapped only around the top edges of the base board, thereby loosely extending into the sides of the base board. Rather than wrapping completely around the sides of the base board, such a molding may utilize guiding slots, grooves or notches along the sides of the base board.

Figure 7B:
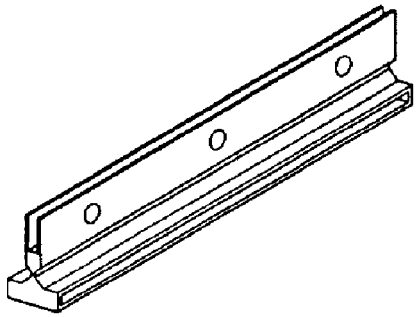
FIG. 7B is a perspective view of a sliding mechanism (complete sleeve).
Figure 7C:
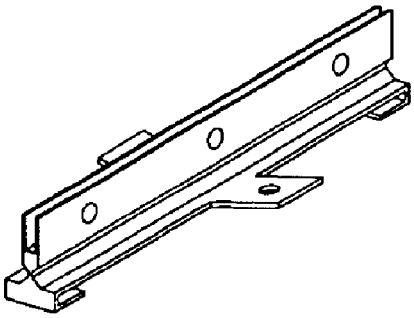
FIG. 7C is a perspective view of a sliding mechanism (with pull tabs).

FIG. 7B illustrates an embodiment of a sliding mechanism that completely wraps around the base board thereby forming a complete sleeve. FIG. 7C illustrates a molding that includes at least one tab that may be pulled to adjust the location of the sliding mechanism. Such a tab may also, for example, be placed in the middle of the sliding mechanism such that the pressure applied by a finger onto the tab neither offsets nor impedes the sliding mechanism 30, but rather facilitates its mobility. Such a tab may also contain finger holes to enable a user to easily pull the tab in either direction along the base board. For example, the tab might be slightly bent and rounded so that a user can easily insert a thumb or finger through the hole and pull or push the sliding mechanism (and attached partition board) to a desired location. The tab may be made, for example and without limitation, from plastic, Plexiglas or any other flexible and rigid material, such that the tab is strong enough to grasp firmly and withstand repetitive use over time but flexible enough to withstand weight that may be placed on top of it (e.g., from the contents of the bag) without snapping or breaking.

Figure 7D:
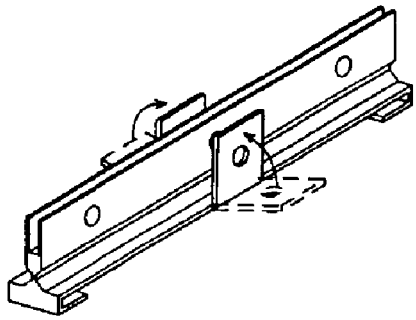
FIG. 7D is a perspective view of a sliding mechanism (with hinged pull tabs).

Alternatively, as illustrated in FIG. 7D, the tabs on the molding may be hinged such that, in their relaxed position, the tabs are relatively perpendicular to the molding itself. When the tabs are being used, the user pulls them down from their relaxed position in order to pull or push the sliding mechanism (and attached partition board) to a desired location. After such use, the tabs spring back to their relaxed position. In such an embodiment, there is less need for the tabs to withstand weight as a result of the contents of the bag.

The various embodiments, structures, and configurations described in the above specification should be considered as merely illustrative of the present invention. They are not intended to be exhaustive or to limit the invention to the forms disclosed. Those skilled in the art will readily appreciate that still other variations and modifications may be practiced without departing from the general spirit of the invention set forth herein. Therefore, it is intended that the present invention be defined by the claims that follow.

We claim:

1. A bag comprising a. a bottom;

b. at least one partition board; and c. at least one sliding mechanism i. coupled to the partition board and ii. slidably coupled to the bottom of the bag enabling the partition board to slide along the bottom of the bag.

wherein at least one side of the bag includes a first fastening mechanism to secure the partition board to the side of the bar; and wherein the partition board includes a second fastening mechanism corresponding to the first fastening mechanism to secure the partition board to the side of the bag when the first and second fastening mechanisms are fastened together.

2. The bag of claim 1 the first fastening mechanism and the second fastening mechanism, in combination, comprise button snaps.

3. The bag of claim 1 wherein the first fastening mechanism and the second fastening mechanism, in combination, comprise hook and loop fasteners.

4. The bag of claim 1 wherein the bottom of the bag includes a base board.

5. The bag of claim 4 wherein the sliding mechanism is a molding detachably wrapped around at least the top edges of the base board.

6. The bag of claim 5 wherein the sliding mechanism further comprises at least one tab extending from the molding.

7. The bag of claim 1 wherein the sliding mechanism is integrated into the bottom of the bag.

8. The bag of claim 1 wherein the sliding mechanism is detachable from the bottom of the bag.

9. The bag of claim 1 wherein the partition board is removable from the sliding mechanism.

10. The bag of claim 1 wherein the partition board includes a hole for a user to grasp order push or pull the partition board from side to side.

11. The bag of claim 1 wherein the sliding mechanism includes a locking mechanism.

12. A bag comprising a. a bottom;

b. at least one partition board; and c. at least one sliding mechanism i. coupled to the partition board and ii. slidably coupled to the bottom of the bag enabling the partition board to slide along the bottom of the bag, wherein the sliding mechanism includes a hinge that enables the partition board to fold down on the bottom of the bag.

13. The bag of claim 12 wherein the bottom of the bag includes a base board.

14. The bag of claim 13 wherein the sliding mechanism is a molding detachably wrapped around at least the top edges the base board.

15. The bag of claim 14 wherein the sliding mechanism further comprises at least one tab extending from the molding.

16. The bag of claim 12 wherein the sliding mechanism is integrated into the bottom of the bag.

17. The bag of claim 12 wherein the sliding mechanism is detachable from the bottom of the bag.

18. The bag of claim 12 wherein the partition board is removable from the sliding mechanism.

19. The bag of claim 12 wherein the partition board includes a hole for a user to grasp in order push or pull the partition board from side to side.

20. The bag of claim 2 wherein the sliding mechanism includes a locking mechanism.

21. A bag comprising a. a bottom;

b. at least one partition board; and c. at least one sliding mechanism i. coupled to the partition board and ii. slidably coupled to the bottom of the bag enabling the partition board to slide along the bottom of the bag.

wherein the coupling between the sliding mechanism and the partition board provides a hinge that enables the partition board to fold down on bottom of the bag.

22. The bag of claim 21 wherein the bottom of the bag includes a base board.

23. The bag of claim 22 wherein the sliding mechanism is a molding detachably wrapped around at least the top edges of the base board.

24. The bag of claim 23 wherein the sliding mechanism further comprises at least one tab extending from the molding.

25. The bag of claim 21 wherein the sliding mechanism is integrated into the bottom of the bag.

26. The bag of claim 21 wherein the sliding mechanism is detachable from the bottom of the bag.

27. The bag of claim 21 wherein the partition board is removable from the sliding mechanism.

28. The bag of claim 21 wherein the partition board includes a hole for a user to grasp in order push or pull the partition board from side to side.

29. The bag of claim 21 wherein the sliding mechanism includes a locking mechanism.

* * * * *